United States Patent [19]

Bone et al.

[11] Patent Number: 4,602,418

[45] Date of Patent: Jul. 29, 1986

[54] CABLE TIE INSTALLATION TOOL

[75] Inventors: Arnold R. Bone, Needham; Terence J. Jones, Bedford, both of Mass.

[73] Assignee: Dennison Manufacturing Company, Framingham, Mass.

[21] Appl. No.: 406,132

[22] Filed: Aug. 9, 1982

[51] Int. Cl.[4] ..... B21F 9/02

[52] U.S. Cl. ..... 29/566.1; 29/278; 140/93.2; 140/123.6

[58] Field of Search ..... 140/123.6, 93.2; 29/566.4, 278, 564.6, 564.8, 566.1

[56] References Cited

U.S. PATENT DOCUMENTS

| | | | |
|---|---|---|---|
| 3,047,945 | 8/1962 | Logan | 140/123.6 |
| 3,168,750 | 2/1965 | Gattiker | 29/278 |
| 3,173,456 | 3/1965 | Bailey | 140/123.6 X |
| 3,332,454 | 7/1967 | Lawson et al. | 140/93.2 |
| 3,344,815 | 8/1967 | Lawson et al. | 140/123.6 |
| 3,433,275 | 3/1969 | Eppler | 140/93.2 |
| 3,735,784 | 5/1973 | Obuch et al. | 140/123.6 X |
| 3,782,426 | 1/1974 | Morgan et al. | 140/123.6 |
| 3,830,263 | 8/1974 | Benfer | 140/123.6 |
| 3,993,109 | 11/1976 | Fortsch | 140/123.6 |
| 4,047,545 | 9/1977 | Paradis | 140/123.6 |
| 4,081,002 | 3/1978 | Violi | 140/123.6 |
| 4,093,005 | 6/1978 | Eberhardt et al. | 140/123.6 |

*Primary Examiner*—Eugene F. Desmond
*Assistant Examiner*—Glenn L. Webb
*Attorney, Agent, or Firm*—George E. Kersey

[57] ABSTRACT

A tool for tensioning and severing elongate objects such as cable ties. The tool includes an angular frame having an extended nose, with a pivotally mounted lever. The lever is forwardly biased by a tension assembly including a tension link and expansion spring, while the cable tie is engaged between a flange and rotatable pawl at the forward end of the tension link. The nosing of the tool includes parallel blades having a user-adjustable separation, for severing cable ties of a wide range of strap thicknesses. The user tensions a cable tie by squeezing the lever toward a grip portion of the frame which is maintained stationary, and may sever the tie after tensioning using a simple twisting motion. The tool is simple, durable, and easy to operate, and is effective for tensioning objects within confined spaces.

10 Claims, 5 Drawing Figures

CABLE TIE INSTALLATION TOOL

BACKGROUND OF THE INVENTION

This invention relates to a tool for the installation of items that require tensioning, and more particularly to a tool for the installation of fasteners such as cable ties.

Cable tie fasteners are commonly installed by wrapping their straps around groups of articles and threading the straps through locking heads. The installation further requires pulling on the free ends of the straps until the articles are securely bundled. The free end typically is then severed in the vicinity of the head when a specified level of tensioning has been reached. To achieve a suitable installation it is advantageous to employ a tool which grips and tensions the free end of the strap.

A wide variety of installation tools are available for effecting the above functions. These tools vary in complexity, and may include elaborate internal structures for controlling the level of tensioning, reducing the force required to achieve a given level of tension, and other purposes. The present tool, however, is of a simple efficient design, an approach which has become increasingly popular.

Such tools are typically inexpensive, durable and hence well suited to heavy duty applications with minimal risk of malfunction. A tool of simple, efficient design should provide facile manipulative control of tensioning. Prior art designs for heavy duty installation tools, however, are awkward in that typically they require moving the body of the tool relative to the object to be tensioned. Furthermore, such prior art tools often raise considerable difficulties in the installation of cable ties in relatively inaccessible locations. Another shortcoming is that tools designed for tensioning and severing thick, heavy duty ties have been unsuitable for thinner ties, principally as to the severing function.

U.S. Pat. Nos. 3,284,076 and 3,344,815, assigned to the Thomas & Betts Co., Raritan, N.J., disclose a strap tightening and cutting tool that is said to be of rugged, durable design. The tool is operated by squeezing a pivoting handle toward a grip portion at the rear, thereby drawing back a tension plate. The tension plate carries at the front a rotatably biased pawl and a flange for engaging a strap, and is forwardly biased by a spring between the handle and tool grip. The tool further includes an internal cutter assembly which is actuated at a given tensioning level. The design has the disadvantage of high probability of mechanical interference in confined areas. Furthermore, the use of a complex internal cutter mechanism makes the tool vulnerable to mechanical failure.

Accordingly, it is a principal object of the invention to provide an installation tool for tensioning cable ties and like objects having a simple, durable design. A related object of the invention is that such a tool include a small number of moving parts, and avoid delicate mechanisms. A further related object is reducing the risk of malfunction during the normal operation of the tool.

Another object of the invention is to achieve an efficient mechanical design which reduces user fatigue. Desirably, the tool should permit installation of cable ties and the like while maintaining the body of the tool stationary, to facilitate use.

A further object of the invention is the provision of an installation tool design which permits tensioning of cable ties in relatively inaccessible locations.

Still another object is the provision of a sever device in such a tool which does not require delicate mechanisms, yet allows the tensioning and severing of both heavy and light straps. A related object is the design of an easily adjustable yet durable sever mechanism.

Illustrative installation tools of the prior art are disclosed in U.S. Pat. Nos.: 2,175,478; 2,729,994; 2,882,934; 3,154,114; 3,168,119; 3,169,560 (U.S. Pat. No. Reissue 26,492); 3,173,456; 3,332,454; 3,433,275; 3,661,187; 3,712,346; 3,735,784; 3,752,199; 3,983,111; 3,993,109; and 4,064,918.

SUMMARY OF THE INVENTION

In accomplishing the above and additional objects, the invention consists of an installation tool incorporating as its principal structure an angular frame, with a pivotally mounted lever for manual tensioning of a free end of an item such as a cable tie. The lever is forwardly biased by a tensioning assembly, which engages the cable tie. The user manually tensions the cable tie by squeezing the lever toward a grip portion of the frame, overcoming a countervailing force exerted on the tensioning assembly. The tool incorporates an adjustable cutter mechanism, which permits severing of both light and heavy cable tie straps.

In accordance with one aspect of the invention, the angular frame includes an elongate nose portion, and a grip portion rearwardly thereof. The lever is pivotally mounted to the frame near the junction of these portions. The feature of an elongate nose portion permits tensioning of remotely located items.

Another aspect of the invention relates to the preferred design of the tensioning assembly, which includes a tension link and an expansion spring. The tension link is coupled to the lever at the rear, and to the forward end of the frame by an expansion spring. The tension link includes at its forward end a transverse flange and rotatably biased pawl to engage the cable tie strap. The various structures are configured with a view to efficient use of space, while providing an extended range of operation of the tool.

Yet another aspect of the invention relates to the design of an adjustable cutter mechanism at the nosing of the frame. This provides parallel blades, the separation of which may be adjusted in accordance with the thickness of a strap to be severed. In the preferred embodiment, this is achieved by separable upper and lower jaws at the front of the frame, one of which is integral with the frame and the other of which is a discrete part. The discrete jaw is adjustably fastened to the frame, advantageously by a pivotal connection. Alternatively, a unitary construction may be employed, wherein the front of the frame is bifurcated, with upper and lower jaws separated by an elongated gap, the jaws being adjustably coupled at the nosing.

A further aspect of the invention concerns the manner of use, wherein the user preadjusts the gap between the blades in accordance with the thickness of a strap. It is a particularly advantageous aspect of the invention that the tool may be maintained stationary relative to the tie during the tensioning process, thus avoiding awkward manipulation of the tool.

BRIEF DESCRIPTION OF THE DRAWINGS

The above and additional aspects of the invention are further illustrated with reference to the detailed description which follows, taken in conjunction with the drawings in which.

DETAILED DESCRIPTION

Figure 1:
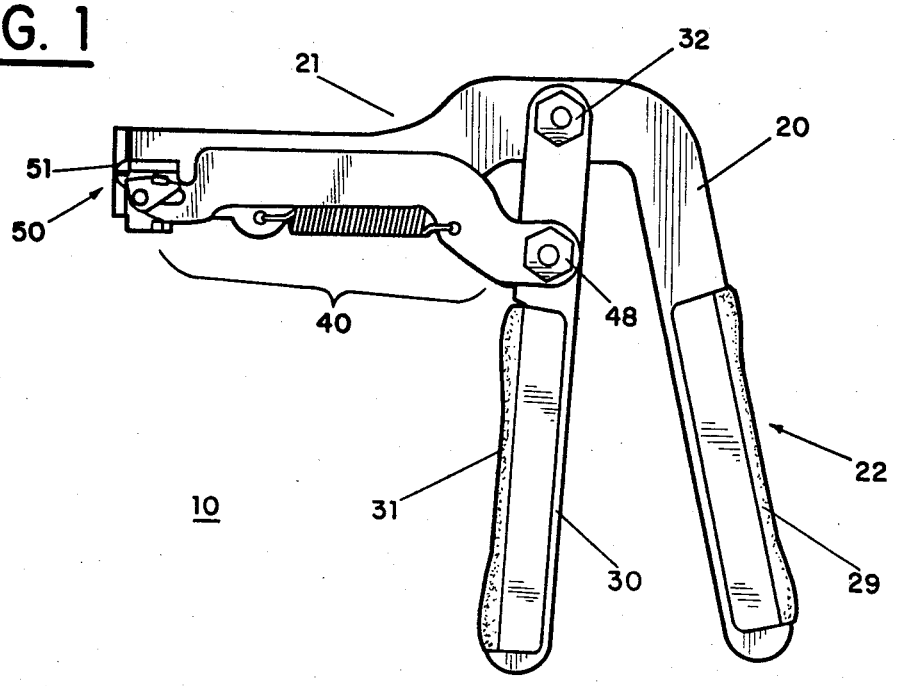
FIG. 1 is a plan view of a cable tie installation tool in accordance with the preferred embodiment.

With reference to the plan view of FIG. 1, illustrating an installation tool 10 in accordance with the preferred embodiment of the invention, the tool includes as its principal components an angular frame 20, a pivotally mounted lever 30, and a slideably mounted tension assembly 40. Installation tool 10 is operated by engaging a grip portion 22 at the rear of the frame, and the lever 30. These parts are shown with removeable hand grips 29 and 31 for manual operation. The frame 20 includes in addition to the grip portion 22, an extended nose portion 21 at the upper part of the tool. The lever 30 is pivotally mounted at 32 near the junction of frame portions 21 and 22.

Figure 2:
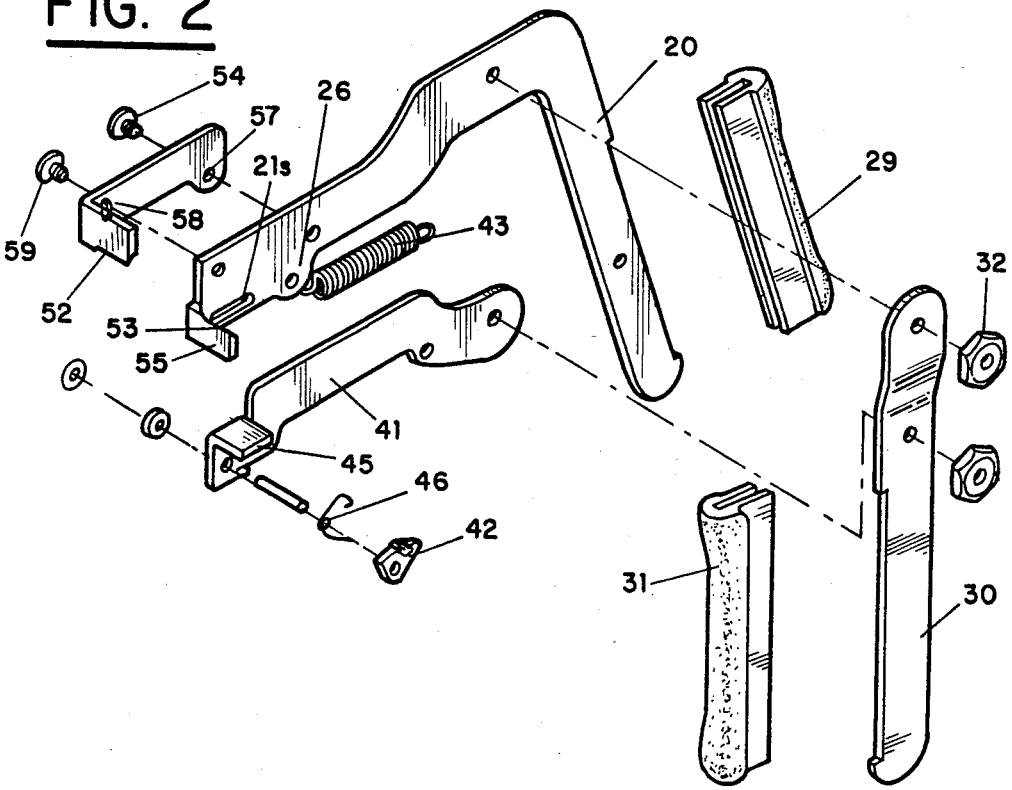
FIG. 2 is an exploded view of the installation tool of FIG. 1.

With reference to the exploded view of FIG. 2, tension assembly 40 consists of a tension link 41 which is slideably mounted in a slot 21s at the forward portion of the frame, and is coupled at its rear at 48 to lever 30. Tension link 41 is further connected to a flange 26 in frame 20 by an expansion spring 43, which biases tension link 41 toward the front of slot 21s. Tension link 41 includes a transverse anvil 45 at its forward end above a rotatably mounted pawl 42. Pawl 42 is urged in a counterclockwise sense by torsion spring 46, causing the pawl to press against the lower surface of anvil 45. The pawl 42 advantageously includes a serrated upper surface, to permit relative rearward movement of a cable tie strap (FIGS. 3A, 3B), while preventing relative forward movement. When tension assembly 40 is at its forwardmost position, a cam surface of pawl 42 abuts against the nosing 50 of frame 20, causing the pawl to separate from anvil 45.

Figure 3A:
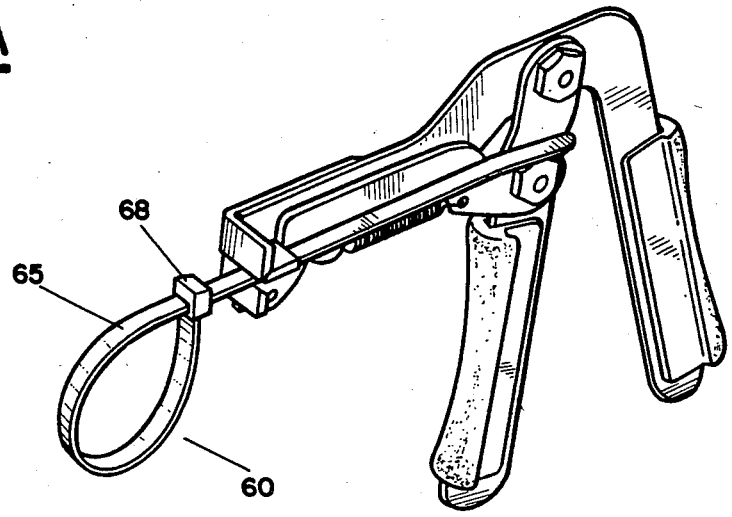
FIG. 3A is a perspective view of the installation tool of FIG. 1 shown engaging a cable tie prior to tensioning.
Figure 3B:
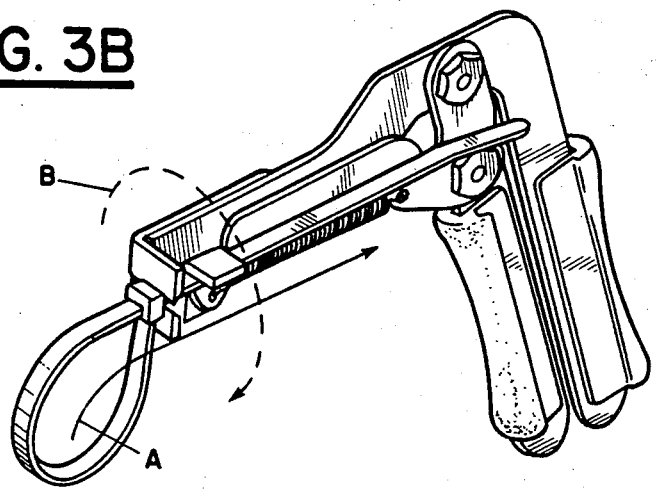
FIG. 3B shows the installation tool of FIG. 3A, with the lever in the extreme tensioned position.

The nosing 50 is medially slotted at 51 to permit insertion of an object to be tensioned, such as a cable tie 60 (FIGS. 3A, 3B). Slot 51 in nosing 50 is indexed by upper and lower blades 52 and 53, which are used to sever strap 65 after tensioning, as explained below. The separation of blades 52 and 53 may be adjusted in accordance with the thickness of strap 65, to allow effective sever. In the preferred embodiment, as best seen in FIG. 2, slot 51 is defined by upper and lower jaws 54 and 55. Lower jaw 55 is integral with frame 20, to which upper jaw 54 is demountably fastened. Upper jaw 54 is pivotally mounted to frame 20 at 57, and includes a further slot 58 near the nosing to permit variable mounting as between two or more vertical locations, through screw 59. Thus, for thick, heavy duty cable ties, screw 59 is placed at the lower end of slot 58, providing a separation of around 100 mils for blades 52 and 53. For a thinner, lighter tie a 60–70 mil gap would be suitable, and is achieved by mounting screw 59 at the upper end of slot 58.

Figure 4:
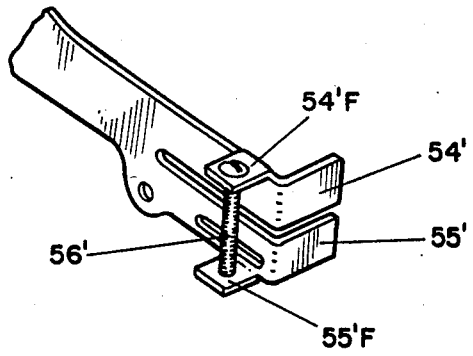
FIG. 4 is a partial perspective view of an alternative cable tie sever mechanism in an installation tool of the type shown in FIG. 1.

In an alternative embodiment partially shown in FIG. 4, jaws 54' and 55' are both integral with frame 20', and are separated by a slot 51' which extends significantly beyond the nosing 50. Jaws 54' and 55' respectively carry ears 54'f, 55'f, which are coupled by a screw 56 to provide a user-adjustable interval between these jaws.

After adjusting the separation of jaws 54 and 55 the user inserts the strap 65 of cable tie 60 through slot 51 and between anvil 45 and pawl 42, having previously inserted the strap through the head 68 of cable tie 60 (FIG. 3A). The user then completes tensioning of cable tie 60 by repeatedly squeezing lever 30 toward grip portion 22, drawing back successive lengths of strap 65 (FIG. 3B), until a desired level of tension is achieved. The user may then sever that portion of cable tie 60 exterior to tool 10 from the remainder of the strap. This is done using a simple twisting motion, as shown by the arcuate arrow A. This torsion causes blades 52 and 53 of nosing 50 to sever the strap at that point.

Installation tool 10 is designed to permit tensioning of objects such as cable tie 60 while avoiding awkward hand motions. This is an advantageous result of the forwardly biased, slideably mounted tensioning assembly 40. The frame 20 and other structures of tool 10 are configured to permit tensioning and severing objects in tightly confined spaces, due to the features of an extended nose portion 21, and an otherwise compact design for tool 10.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. A tool for installing an item having a free end, comprising:

a frame having an elongate nose portion forming an elbow with a grip portion at the rear end therof, said frame housing a pair of opposed jaws at its forward end having a pair of facing blades;

means for adjusting the placement of at least one of said jaws to fix the blades at a desired separation;

a lever pivotally mounted to the nose portion of said frame adjacent said elbow;

a tension arm slideably mounted in a slot of said frame and linked to said lever to move rearwardly in response to a pivoting of said lever towards said grip portion, said tension arm including means for gripping the free end of said item; and means for forwardly tensioning said tension arm and said lever.

2. An installation tool as defined in claim 1, wherein the biasing means comprises an extension spring coupling the tension arm to the frame.

3. An installation tool as defined in claim 1 wherein the blades are respectively part of a first jaw integral with the frame, and a second jaw demountably connected to the frame.

4. An installation tool as defined in claim 3 wherein the second jaw is pivotally connected to the frame rearwardly of its blade, and is fixed to said frame adjacent the cutting edges so as to permit adjustment of their separation.

5. An installation tool as defined in claim 1 wherein the separation of said blades is adjustable between about 60 mils and 100 mils.

6. A tool as defined in claim 1 wherein said jaws comprise a first jaw integral with said frame, and a second jaw demountably fixed to said frame.

7. A tool as defined in claim 6 wherein the second jaw is pivotally mounted to said frame, rearwardly of its front end.

8. A tool as defined in claim 6, wherein the second jaw is adjustably mounted between two extremes defined by adjustably fastening said second jaw to the first jaw adjacent their front ends.

9. A tool as defined in claim 1 wherein the jaws are integral with the tool body, and are separated by an elongate slot extending beyond the blades.

10. An installation tool as defined in claim 1 comprising:

an angular frame;

a lever pivotally mounted on said frame;

a tension assembly connected to said frame and comprising a tension link slideably mounted in a slot of said frame and pivotally coupled to said lever;

said tension link being connected to a flange in said frame by an expansion spring to bias said tension link towards the front of said slot;

said tension link further including a transverse anvil and a rotatably mounted pawl which is urged in a counterclockwise sense by a tension spring to cause the pawl to press against the lower surface of said anvil;

a lower jaw with a blade thereon integrally connected to said frame and an upper jaw adjustably positioned on said frame relative to said lower jaw.

* * * * *